US011594829B2

(12) United States Patent
Wu et al.

(10) Patent No.: US 11,594,829 B2
(45) Date of Patent: Feb. 28, 2023

(54) CONDUCTOR ASSEMBLY STRUCTURE FOR RAIL-TYPE TERMINAL DEVICE

(71) Applicants: SWITCHLAB INC., New Taipei (TW); SWITCHLAB (SHANGHAI) CO., LTD., Shanghai (CN); GAOCHENG ELECTRONICS CO., LTD., Shenzhen (CN)

(72) Inventors: Chih-Yuan Wu, New Taipei (TW); Biao Huang Hsu, New Taipei (TW)

(73) Assignees: Switchlab Inc., New Taipei (TW); Switchlab (Shanghai) Co.. Ltd., Shanghai (CN); Gaocheng Electronics Co., Ltd., Shenzhen (CN)

( * ) Notice: Subject to any disclaimer, the term of this patent is extended or adjusted under 35 U.S.C. 154(b) by 0 days.

(21) Appl. No.: 16/951,295

(22) Filed: Nov. 18, 2020

(65) Prior Publication Data

US 2021/0151911 A1 May 20, 2021

(30) Foreign Application Priority Data

Nov. 20, 2019 (TW) ..... 108142161

(51) Int. Cl.

| | |
|---|---|
| ***H01R 9/26*** | (2006.01) |
| ***H01R 4/36*** | (2006.01) |
| ***H01R 4/48*** | (2006.01) |
| ***H01R 13/40*** | (2006.01) |
| ***H01R 13/627*** | (2006.01) |

(52) U.S. Cl.

CPC ..... *H01R 9/26* (2013.01); *H01R 4/36* (2013.01); *H01R 4/48* (2013.01); *H01R 13/40* (2013.01); *H01R 13/627* (2013.01)

(58) Field of Classification Search

CPC ..... H02B 1/052; H01R 9/2408; H01R 9/18; H01R 9/223; H01R 4/4845; H01R 4/30; H01R 9/2483; H01R 4/64; H01R 9/2691; H01R 9/26; H01R 4/4827; H01R 9/2608; H01R 9/2675; H01R 25/142;

(Continued)

(56) References Cited

U.S. PATENT DOCUMENTS 4,454,382 A * 6/1984 Borne ..... H02B 1/052 439/817
5,174,767 A * 12/1992 Diekmann ..... H01R 9/2691 439/94

(Continued)

*Primary Examiner* — Gary F Paumen
(74) *Attorney, Agent, or Firm* — Rosenberg, Klein & Lee

(57) ABSTRACT

A conductor assembly structure for a rail-type terminal device includes a conductor assembly and an insulating housing. The conductor assembly structure can reduce manufacturing waste and has a larger contact surface and a better electric conduction effect. The conductor assembly has a base portion that can be pivotally connected with a conductive connector, and a first area and a second area connected to the base portion. The first area and the second area are respectively formed with a bowed portion and a first section and a second section connected to the bowed portion to be snapped onto a grounding mounting rail. At least one of the first area and the second area is provided with a load arm and an elastic member connected to the load arm for increasing the elastic fixing effect (force) of the first section and/or the second section on the grounding mounting rail.

36 Claims, 7 Drawing Sheets

(58) Field of Classification Search
CPC .. H01R 4/4818; H01R 9/2416; H01R 9/2625; H01R 4/36; H01R 4/48; H01R 13/40; H01R 13/627
See application file for complete search history.

(56) References Cited

U.S. PATENT DOCUMENTS 5,362,259 A * 11/1994 Bolliger ..... H01R 9/2691 439/716
5,928,008 A * 7/1999 Munshi ..... H01R 9/2691 439/94
6,471,552 B2 * 10/2002 Bechaz ..... H01R 9/2691 439/716
6,916,214 B2 * 7/2005 Conrad ..... H01R 9/2608 439/716
7,686,627 B2 * 3/2010 Wu ..... H01R 9/2691 439/95
7,922,521 B1 * 4/2011 Wu ..... H01R 9/2691 439/532
8,231,391 B2 * 7/2012 Boecker ..... H01R 9/2608 439/94
9,806,479 B2 * 10/2017 Pizzi ..... H01R 13/627
9,831,569 B2 * 11/2017 Hoppmann ..... H01R 9/26

* cited by examiner

CONDUCTOR ASSEMBLY STRUCTURE FOR RAIL-TYPE TERMINAL DEVICE

FIELD OF THE INVENTION

The present invention relates to a conductor assembly structure for a rail-type terminal device, and more particularly to a conductor assembly having a load arm combined with an elastic member to increase the elastic clamping and fixing effect of the conductor assembly.

BACKGROUND OF THE INVENTION

A terminal device or crimp terminal uses a metal assembly (or conductive member) and an elastic conductor (or metal elastic plate) wrapped in an insulating housing (usually made of plastic materials) to press or connect the wire inserting into the terminal device to form an electrical connection or release the wire, which is a well-known art.

This type of electrical connection terminal includes a type that is inserted into a circuit board (such as, a PC circuit board), and a type of snap-fit grounding mounting rail (or conductive rail) with electrical connection terminals arranged side by side, so as to establish a common grounding device for electrical or mechanical equipment to drain the residual voltage or static electricity of the equipment.

This type of electrical connection terminal (or rail-type electrical connection terminal) usually includes an insulating housing. The housing has a wire inlet for a wire to be inserted into the housing. The housing also defines a cavity to be equipped with a platy conductive support (or conductor assembly) for pivotally connecting the grounding wires from the equipment. The conductor assembly has a metal grounding member, which is welded, riveted or connected to the conductive support. The metal grounding member has two ends to be respectively snapped onto a grounding mounting rail (or conductive rail). The operator may use a tool (such as a screwdriver) to pull a hooked foot area at the lower end of the insulating housing, so that the foot area drives one end of the grounding member to deform and offset outwardly, so as to disengage the grounding member from the mounting rail.

A topic related to the structure and operation of the conventional electrical connection terminal structure is that both ends of the grounding member is easily deformed due to the outward pulling operation by the operator. Because of improper operation by the operator and/or long-term (or high-frequency) use, it is easy to reduce the subsequent fastening and fixing effect with the mounting rail and affect the electric conduction effect of the conductor assembly.

In order to improve the foregoing situation, the prior art also discloses a structure in which multiple grounding members are connected side by side. However, those who are familiar with this technique know that the structure having multiple grounding members connected side by side not only increases the material cost but also relatively requires a lot of operating force exerted by the operator to pull the grounding members outwardly. Therefore, the operation is laborious. This is not what we expect.

Typically, these references show the structural combination design and application of the electrical connection terminal device. If the structure of the conductor assembly or the grounding member can be redesigned to make its structure different from the prior art, it will change its use and be different from the prior art. In fact, it will also increase its application effect.

A more ideal terminal device or conductor assembly needs to be able to overcome or improve the issues discussed above. It should also include the following design considerations.

1. Their matching structure needs to be able to establish a stable elastic fixing mechanism, so that the grounding member or conductor assembly can respond to improper operation by the operator and/or long-term (or high frequency) use, without reducing their subsequent buckling and fixing with the mounting rail to affect the electric conduction effect of the conductor assembly.

2. It is necessary to remove the structure that in the prior art multiple grounding members or conductor assemblies are connected side-by-side, so as to improve its material cost and labor-intensive operation.

3. Under the condition of reducing (or not increasing) manufacturing waste, the grounding members or conductor assemblies are formed into an integral structure to improve the efficiency of its manufacturing, processing and assembly. In addition, it is necessary to provide a larger or wider contact surface or conductive contact surface, which can relatively improve the electric conduction efficiency and is suitable for different wires with large and small diameters.

SUMMARY OF THE INVENTION

The primary object of the present invention is to provide a conductor assembly structure for a rail-type terminal device, comprising a conductor assembly and an insulating housing. The conductor assembly structure can reduce manufacturing waste and has a larger contact surface and a better electric conduction effect. The conductor assembly has a base portion that can be pivotally connected with a conductive connector, and a first area and a second area connected to the base portion. The first area and the second area are respectively formed with a bowed portion, and a first section and a second section connected to the bowed portion and configured to be snapped onto a grounding mounting rail. At least one of the first area and the second area is provided with a load arm and an elastic member connected to the load arm. The elastic member is movable in response to movement of at least one of the first section and the second section for accumulating and releasing energy and for increasing the elastic fixing effect (force) of the first section and/or the second section on the grounding mounting rail, thereby improving the problem that the prior art is likely to cause unstable fastening and elastic fatigue to affect the fixing effect due to long-term or high frequency use.

According to the conductor assembly structure for a rail-type terminal device of the present invention, the conductor assembly is an integrally formed structure. An upper end of the base portion is formed with a first arm and a second arm. The first arm and the second arm extend laterally, respectively. The load arm is in a T-shaped configuration and has a secondary arm. A distance is defined between the secondary arm and the first area (or the second area) to establish a limit distance to regulate the movement range or displacement of the first section (or the second section) or the load arm. This can reduce the elastic (or material) fatigue or fracture of the first section (or the second section) due to improper operation by the operator or long-term (or high frequency) use.

DETAILED DESCRIPTION OF THE PREFERRED EMBODIMENTS

Embodiments of the present invention will now be described, by way of example only, with reference to the accompanying drawings.

Figure 1:
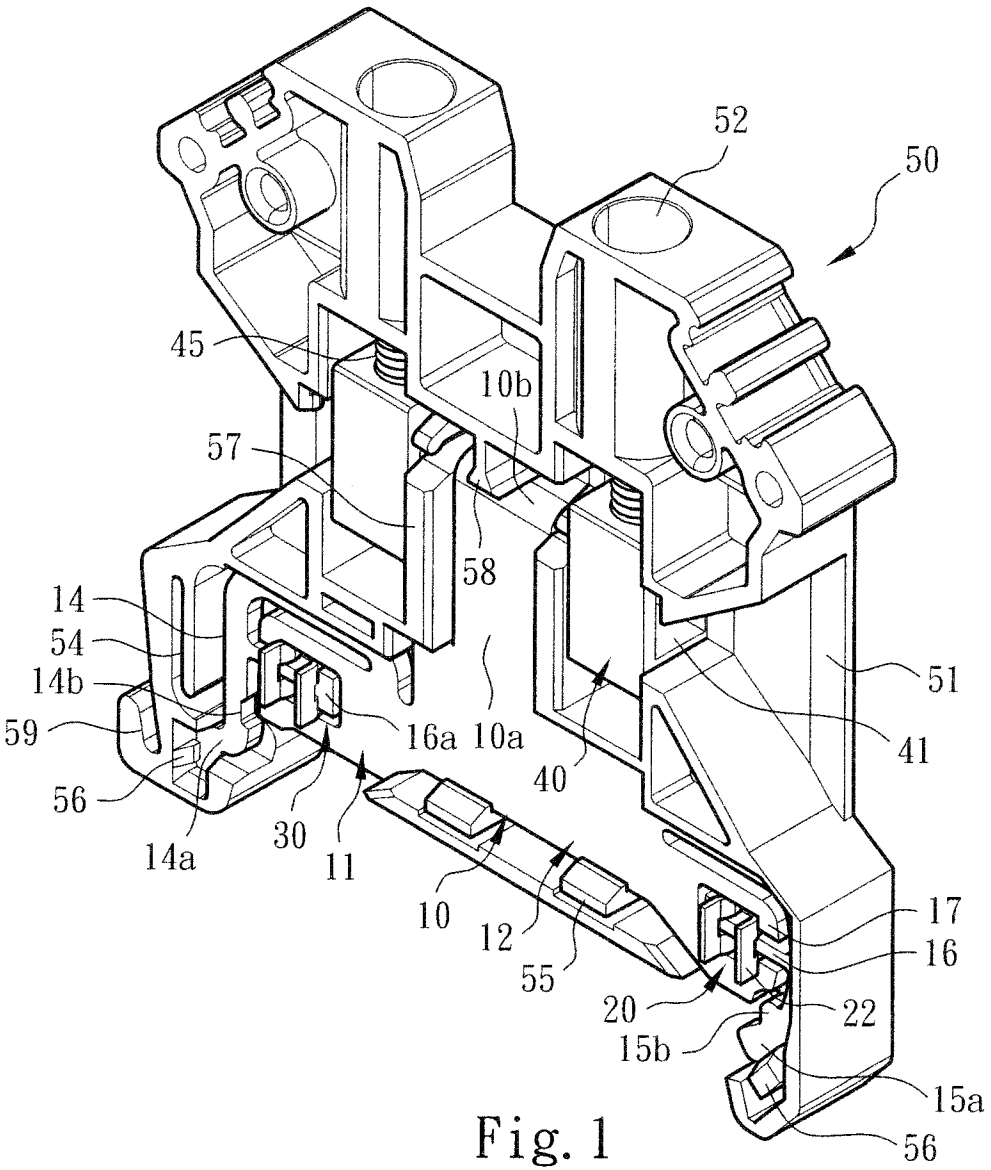
FIG. 1 is a perspective view of the conductor assembly combined with the housing of the present invention.
Figure 2:
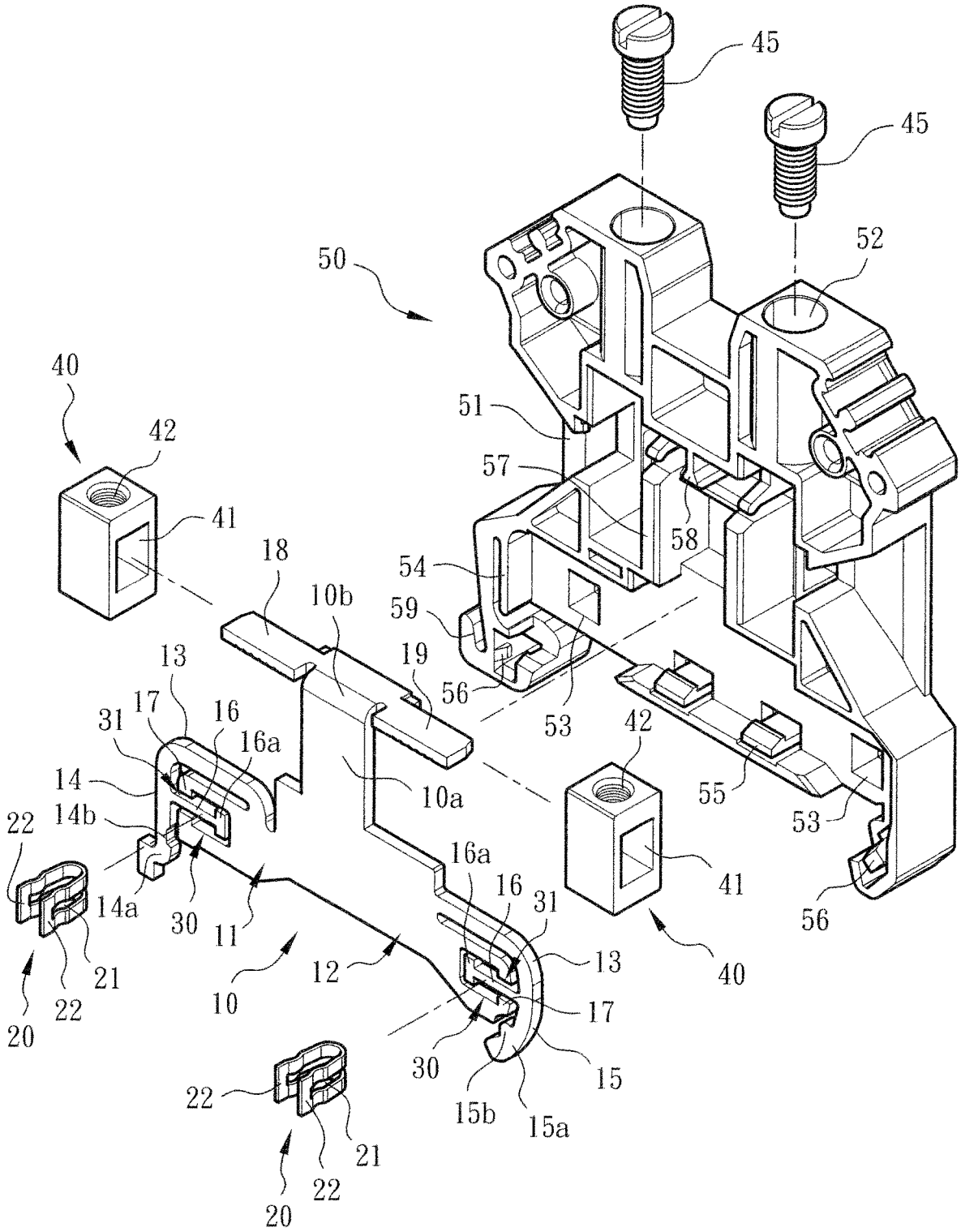
FIG. 2 is an exploded view of FIG. 1, illustrating the housing, the conductor assembly, the conductive connector and the elastic member.
Figure 3:
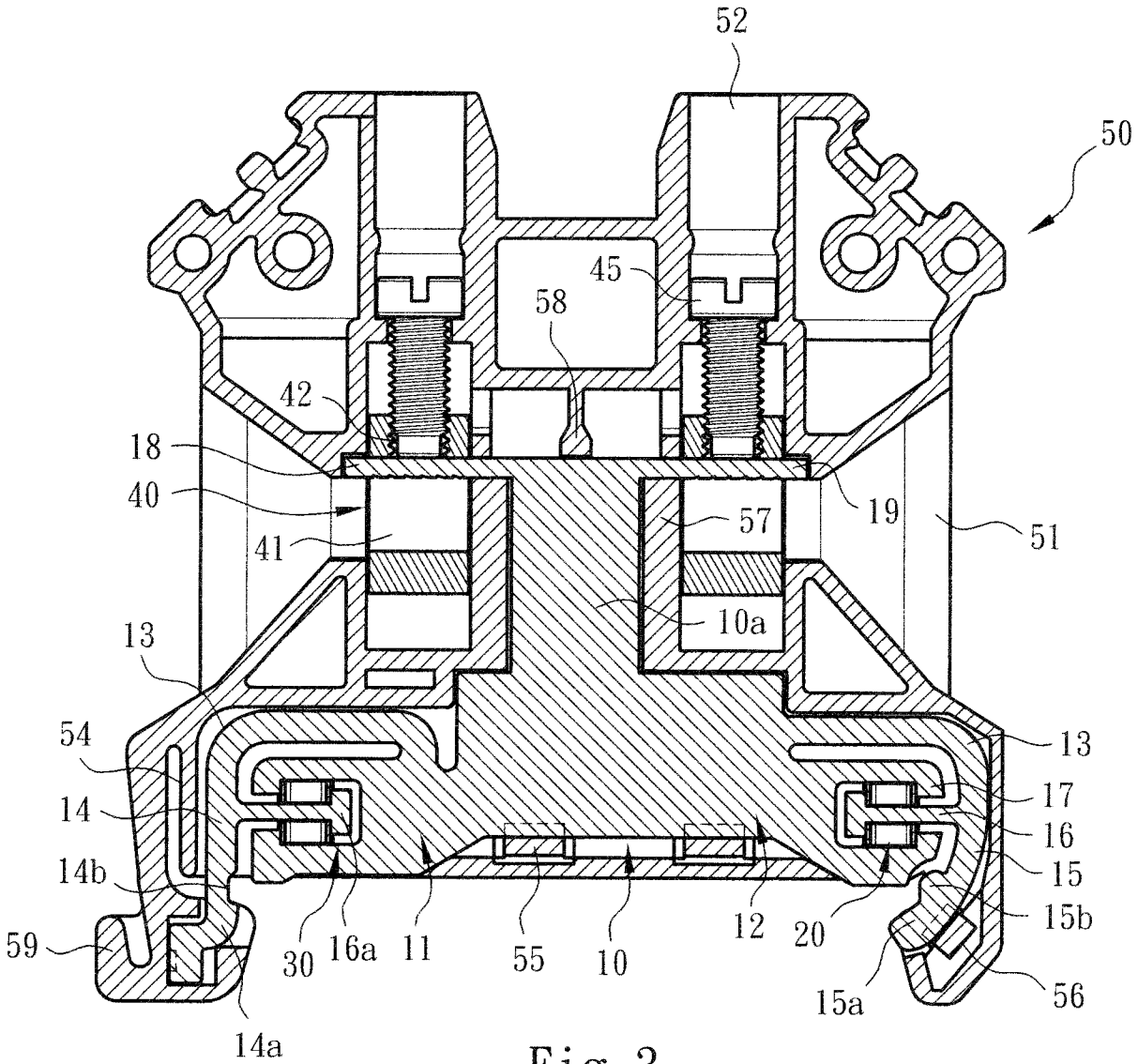
FIG. 3 is a cross-sectional view of FIG. 1.

Referring to FIGS. 1, 2 and 3, a conductor assembly structure for a rail-type terminal device of the present invention includes a conductor assembly (or grounding member) that is represented by reference number 10. The conductor assembly 10 is installed in a housing 50 made of an insulating material to form an electrical terminal device or a wire connection terminal. The housing 50 has a wire inlet 51 for insertion of a wire and an operation hole 52.

In the following description, the upper portion, above, lower portion, under, side, and the like are based on the direction shown in the figures as the reference direction.

In this embodiment, the conductor assembly 10 is generally in a platy configuration, having a base portion 10*a*, a first area 11 and a second area 12. The first area 11 and the second area 12 are connected to the base portion 10*a* and extend laterally as shown in the figures, respectively. The first area 11 and the second area 12 are each formed with a bowed portion 13, and a first section 14 and a second section 15 are connected to the bowed portion 13, so that the first section 14 and the second section 15 can be respectively (elastically) snapped onto a grounding mounting rail (not shown) to form an electrical grounding function.

As shown in the figures, a distal end 14*a* of the first section 14 defines a recess 14*b*. A lip 15*b* protrudes from a distal end 15*a* of the second section 15. The lip 15*b* cooperates with the recess 14*b* (and/or the housing 50) of the first section 14 to fix the conductor assembly 10 to the mounting rail tightly.

As shown in FIG. 2 and FIG. 3, at least one of the first area 11 and the second area 12 is provided with a load arm 16 and an elastic member 20 mounted to the load arm 16. The elastic member 20 is movable in response to movement of the first section 14 and/or the second section 15 to establish a mechanism for accumulating and releasing energy and for increasing the elastic fixing effect (force) of the first section 14 and/or the second section 15 on the grounding mounting rail, thereby improving the problem that the prior art is likely to cause unstable fastening and elastic fatigue to affect the fixing effect due to long-term or high frequency use.

In detail, the first area 11 and/or the second area 12 define a space 30. The first area 11 and/or the second area 12 is provided with a shoulder 17 close to the space 30 to define an opening 31 communicating with the space 30. The load arm 16 is in a T-shaped configuration and has a secondary arm 16*a*. One end of the load arm 16 is connected to the first section 14 (and/or the second section 15), so that the other end of the load arm 16 or at least one portion of the load arm 16 (and the second arm 16*a*) is located in the space 30.

In this embodiment, the elastic member 20 is in a U-shaped configuration having a groove 21 and two closed portions 22 located at two ends of the groove 21. Therefore, when the groove 21 of the elastic member 20 is connected to the load arm 16, the closing portions 22 abut against the secondary arm 16*a* and the shoulder 17, respectively. The elastic member 20 is located in the space 30.

In a feasible embodiment, the housing 50 may be formed with a hole 53 for positioning the elastic member 20.

As shown in FIG. 2 and FIG. 3, the housing 50 is provided with a rib-shaped stop portion 54 for limiting a movement distance or displacement of the first section 14 (and/or the second section 15) of the conductor assembly or the load arm 16. This can reduce the elastic (or material) fatigue or fracture of the first section 14 (or the second section 15) due to improper operation by the operator or long-term (or high frequency) use to affect the fastening and fixing function of the mounting rail and the electric conduction effect of the conductor assembly.

In consideration of reducing (or not increasing) manufacturing waste, the conductor assembly 10 is an integrally formed structure to improve its manufacturing, processing and assembly efficiency. The upper end of the base portion 10*a* is formed with a bent portion 10*b*, a first arm 18 and a second arm 19. The first arm 18 and the second arm 19 extend laterally from the bent portion 10*b*, respectively. The bent portion 10*b* can increase the structural strength of the conductor assembly 10. The first arm 18 and the second arm 19 each are in a platy configuration, having a wider or larger (electric conduction) contact surface, which relatively improves its electric conduction efficiency and is suitable for different wires with large and small diameters. The first arm 18 and the second arm 19 are configured to pivotally connect a conductive connector 40 or metal elastic plate (for example, ∠-shaped elastic plate, a-shaped elastic plate, etc.).

In this embodiment, the conductive connector 40 is connected with a fastener 45 (for example, a screw). The conductive connector 40 is a modular structure in a box-shaped configuration, so that the conductive connector 40 can be manufactured easily and can be detachably fitted with other specifications of conductive parts. The conductive connector 40 has a mouth 41 and a locking hole 42. The mouth 41 is configured to receive the first arm 18 or the second arm 19.

It can be understood that the wire can be inserted through the wire inlet 51 of the housing 50 into the mouth 41. The fastener 45 is inserted through the operation hole 52 of the housing 50 into the locking hole 42 for locking the wire, the conductive connector 40, the first arm 18 and/or the second arm 19 to form an electrical connection or a wire collection function.

As shown in FIG. 2 and FIG. 3, the bottom of the housing 50 is provided with a main buckle portion 55 and a secondary buckle portion 56. The main buckle portion 55 and the secondary buckle portion 56 enable the housing 50 to fix the conductor assembly 10 (the first area 11 and the second area 12 as well as the distal end 14*a* of the first section 14 and the distal end 15*a* of the second section 15) firmly. This can prevent the conductor assembly 10 from being deformed or warped due to the operation of clamping the wire to break the housing 50 or the terminal device. The housing 50 is provided with a rib-shaped restriction portion 57 and a block-shaped secondary restriction portion 58 located above the restriction portion 57 for fixing the base portion 10*a* of the conductor assembly 10. The housing 50 forms a point or line contact (fixing) mechanism with the restriction portion 57, the secondary restriction portion 58 and the conductor assembly 10, and improves the heat dissipation effect, and avoids the conductor assembly 10 from being deformed due to overheating.

Figure 4:
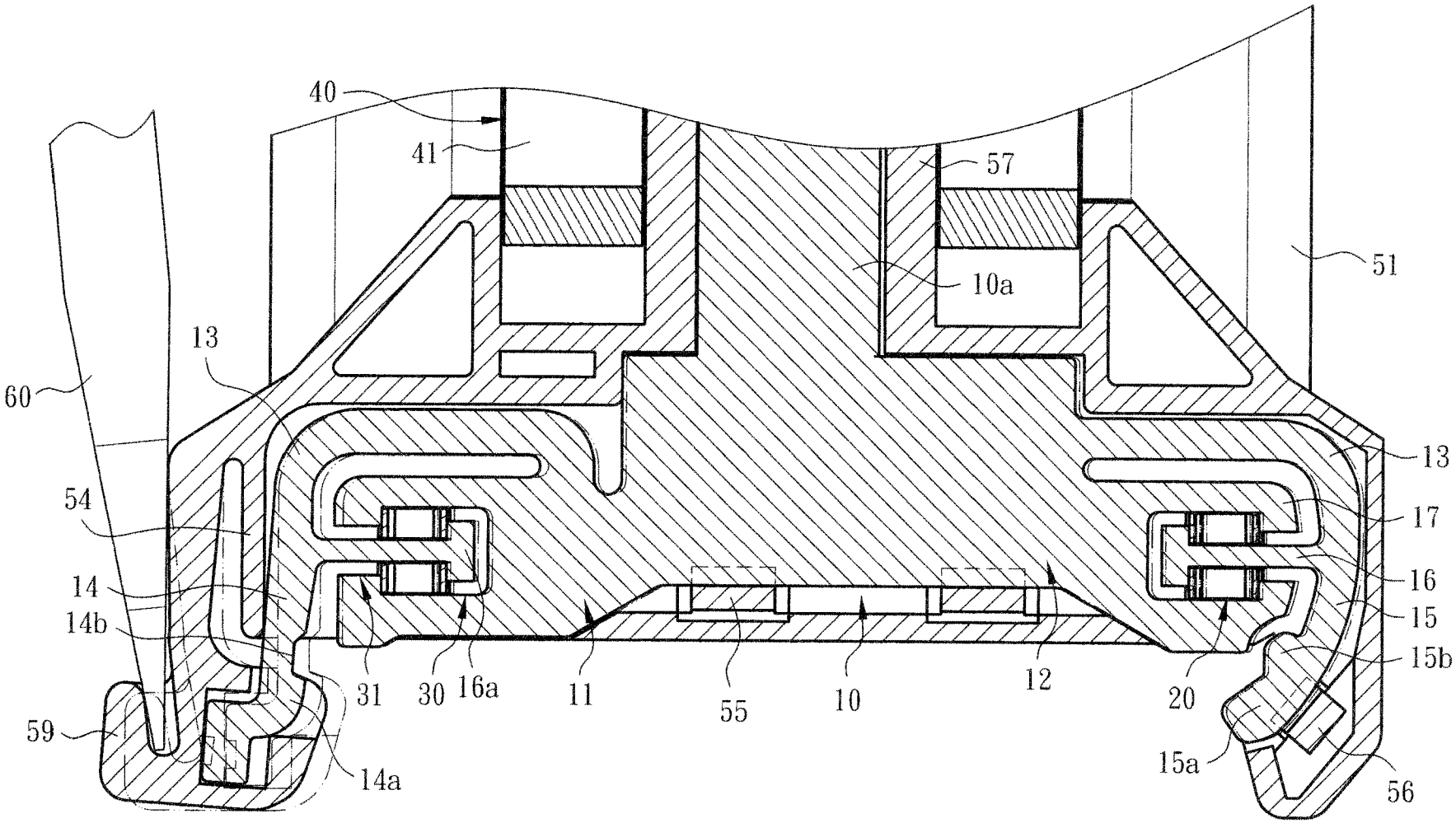
FIG. 4 is a schematic view of the present invention, illustrating movement of the conductor assembly in response to the operation of the operator.

Referring to FIG. 4, when the operator uses a tool 60 (such as a screwdriver) to pull the housing 50 outward (or the left in the figure) from a foot-shaped area 59 at the lower portion of the housing 50, the housing 50 will drive the first section 41 of the conductor assembly 10 to move toward the left in the figure (such as the situation depicted by the imaginary line in FIG. 4). In cooperation with the movement of the first section 14 to the stop portion 54, the load arm 16 (and the secondary arm 16*a*) drives the elastic member 20 to accumulate energy, so as to disengage the recess 14*b* (and the lip 15*b*) from the mounting rail.

It can be understood that when the force exerted by the operator disappears, the elastic member 20 will release the accumulated energy to return the first section 14 to its initial position.

Figure 5:
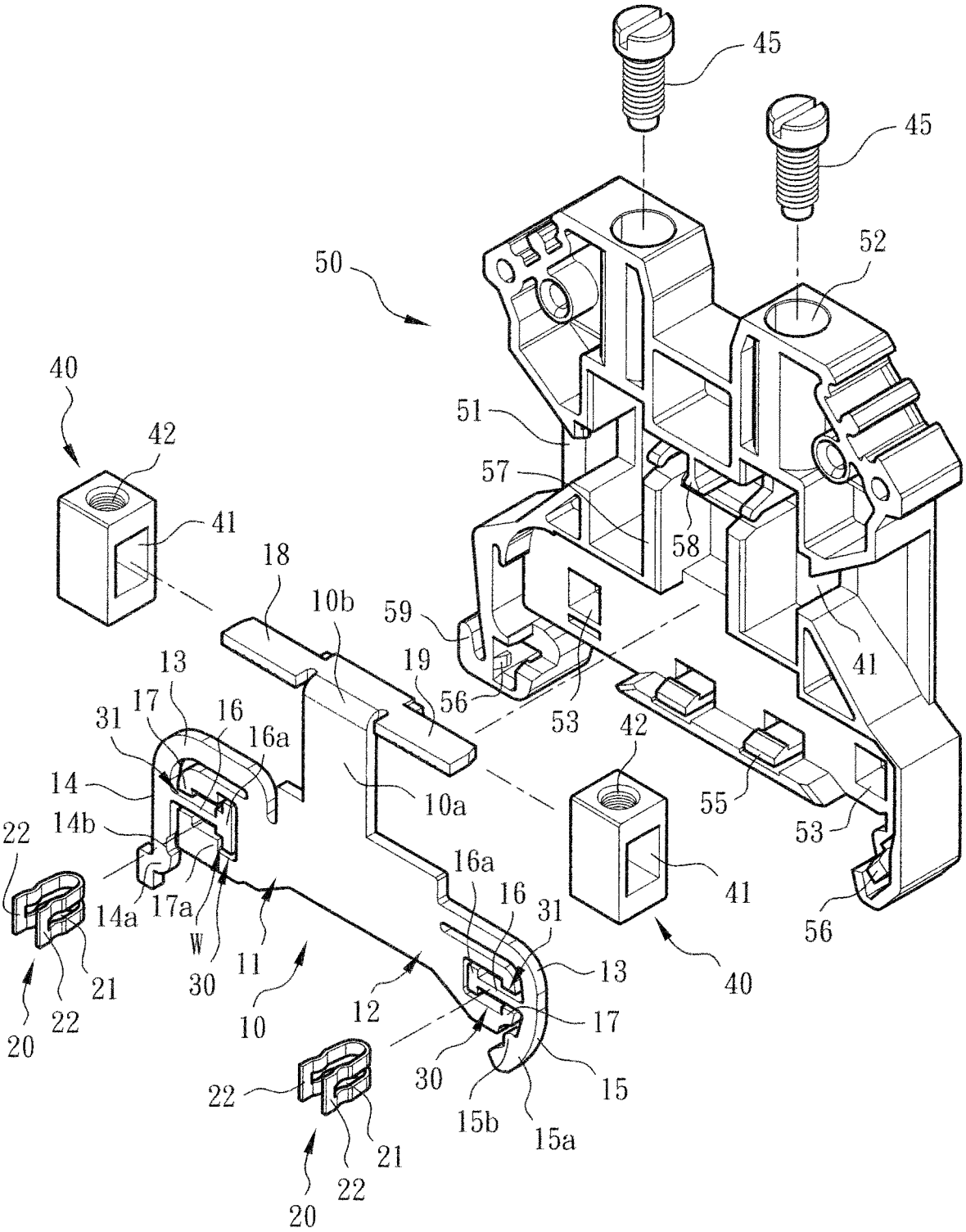
FIG. 5 is an exploded view of a modified embodiment of the present invention, illustrating the housing, the conductor assembly, the conductive connector and the elastic member.
Figure 6:
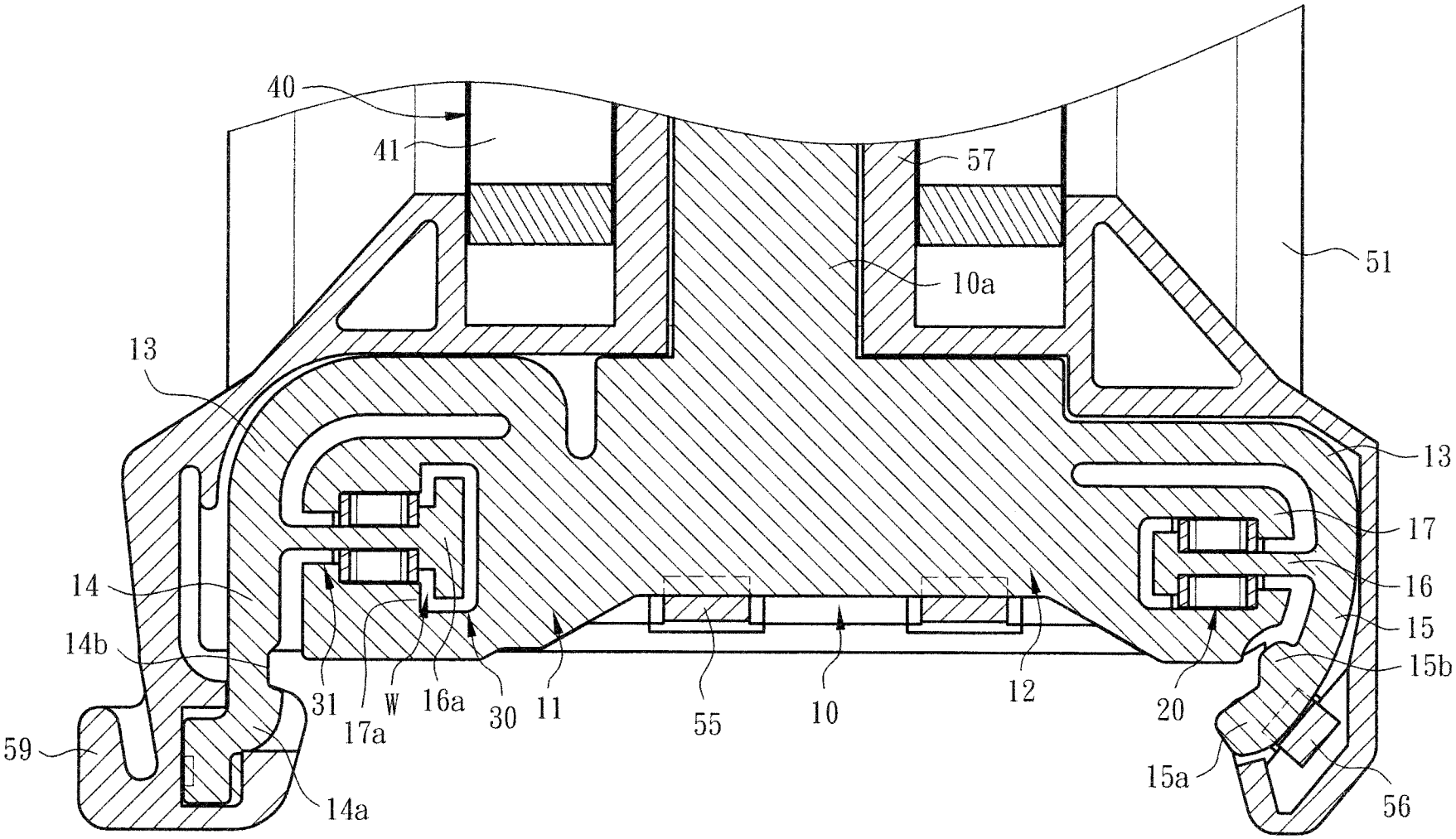
FIG. 6 is a partial cross-sectional view of FIG. 5.

As shown in FIG. 5 and FIG. 6, in a modified embodiment, the first area 11 and/or the second area 12 of the conductor assembly 10 is provided with a secondary shoulder 17*a* in the space 30. A distance w is defined between the secondary shoulder 17*a* and the secondary arm 16*a* to establish a limit distance to regulate the movement range or displacement of the load arm 16 of the first section 14 (or the second section 15). This can reduce the elastic (or material) fatigue or fracture of the first section 14 (or the second section 15) due to improper operation by the operator or long-term (or high frequency) use to affect the fastening and fixing function of the mounting rail and the electric conduction effect of the conductor assembly.

Figure 7:
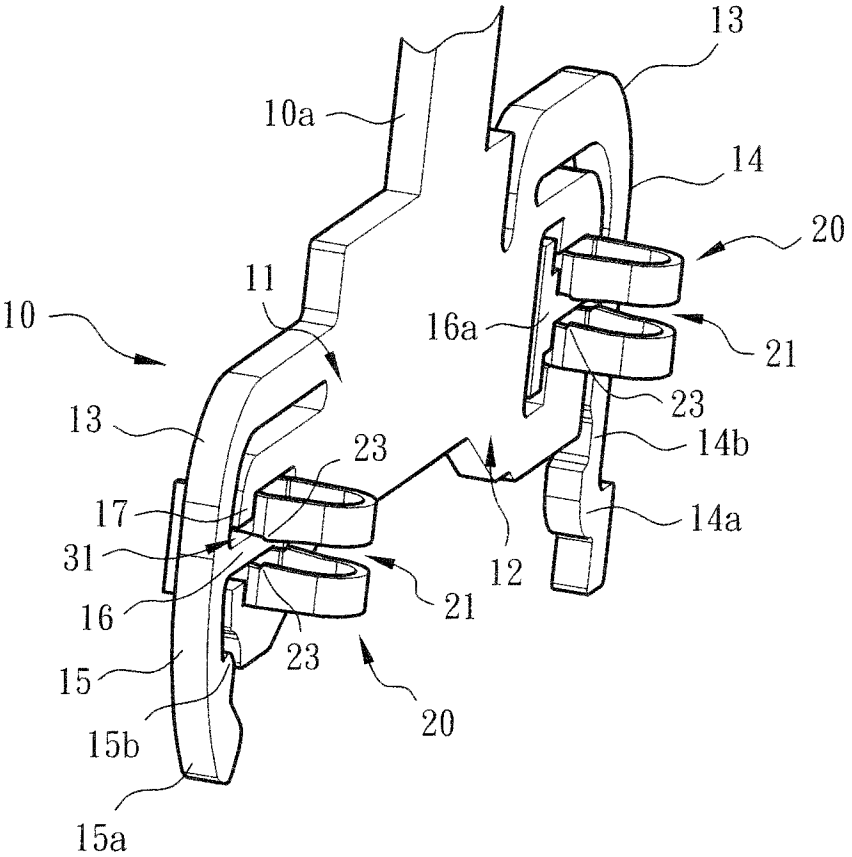
FIG. 7 is a schematic view of a modified embodiment of the elastic member of the present invention combined with the conductor assembly.

FIG. 7 depicts a modified embodiment of the elastic member 20 combined with the conductor assembly 10. The groove 21 of the elastic member 20 is formed with (at least) an oblique raised portion 23. When the oblique raised portion 23 (cooperating with the closed portions 22) facilitates the groove 21 to be connected to the load arm 16, they are respectively located at the front and rear of the load arm 16 to increase the stability of the elastic member 20 installed on the conductor assembly 10.

Typically, the conductor assembly structure used for rack-type terminal devices has the following advantages compared with the prior art under the condition of reducing (or not increasing) manufacturing waste.

1. The structure of the conductor assembly 10, the housing 50 and related components has been redesigned. For example, the conductor assembly 10 includes the base portion 10*a*, the first area 11, the second area 12, the first section 14, the second section 15, the first arm 18 and the second arm 19. The first area 11 and/or the second area 12 are formed with the space 30 and the opening 31. The load arm 16, the secondary arm 16*a* and the elastic member 20 are housed in the space 30. The elastic member 20 has the groove 21 and the closed portions 22, and is connected with the load arm 16 to assist in increasing the elastic effect (force) of the first section 14 and/or the second section 15. The first area 11 and/or the second area 12 is formed with the secondary shoulder portion 17*a*, so that the distance w is defined between the secondary shoulder 17*a* and the secondary arm 16*a* to form a regulation operating distance. The conductor assembly 10 is obviously different from the prior art, and also changes the electric conduction structure or combination relationship of the conventional terminal device. The use and operation are different from the prior art.

2. In particular, the load arm 16 of the conductor assembly 10 is connected with the elastic member 20 to establish a stable elastic fixing mechanism, so that the conductor assembly 10 can improve the subsequent fastening and fixing function with the mounting rail and the electric conduction effect of the conductor assembly in response to improper operation by the operator or long-term (or high frequency) use. In addition, the structure of the conductor assembly 10 also eliminates the configuration that in the prior art multiple grounding members (or conductor assembly) are connected side by side, so that the material costs and laborious operations are significantly improved. The conductor assembly 10 is an integrally formed structure to improve its manufacturing, processing and assembly efficiency, having a larger or wider contact surface or conductive contact surface, which relatively improves its electric conduction efficiency and is suitable for different wires with large and small diameters.

Therefore, the present invention provides an effective conductor assembly structure for rack-type terminal devices. Its spatial configuration is different from that of the prior art, and it has advantages that are incomparable in the prior art. The present invention possesses considerable inventiveness and fully meets the requirements of an invention patent.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A conductor assembly structure for a rail-type terminal device, comprising: a conductor assembly (10), the conductor assembly (10) having a base portion (10*a*), a first area (11) and a second area (12), the first area (11) and the second area (12) being connected to the base portion (10*a*) and respectively extend laterally, the first area (11) and the second area (12) being respectively formed with a bowed portion (13), a first section (14) and a second section (15) being connected to a corresponding one of the bowed portions (13); and at least one of the first section (14) and the second section (15) being provided with a load arm (16) and an elastic member (20), the load arm (16) being in juxtaposition with the elastic member (20), the elastic member (20) being movable in response to movement of at least one of the first section (14) and the second section (15) to apply an elastic force to the load arm (16) responsive the movement thereof and thereby supplement an elastic force of at least one of a corresponding one of the first section (14) and the second section (15).

2. The conductor assembly structure as claimed in claim 1, wherein the conductor assembly (10) is an integrally formed structure, an upper end of the base portion (10*a*) is formed with a bent portion (10*b*), a first arm (18) and a second arm (19), the first arm (18) and the second arm (19) being connected to the bent portion (10*b*) and extending laterally, the first arm (18) and the second arm (19) each being in a platy configuration;

a pair of conductive connectors (40), each conductive connector (40) having a box-shaped configuration, a mouth (41) and a locking hole (42), the locking hole (42) is connected with a fastener (45) and the mouth 41 is sleeved on a respect one of the first arm (18) and the second arm (19).

3. The conductor assembly structure as claimed in claim 1, wherein the conductor assembly (10) is installed in a housing (50) made of an insulating material, the housing (50) has an operation hole (52) and a wire inlet (51) for insertion of a wire;

the housing (50) being formed with a hole (53) for positioning the elastic member (20), the housing (50) being provided with a rib-shaped stop portion (54), a distal end (14*a*) of the first section (14) defines a recess (14*b*), a lip (15*b*) protrudes from a distal end (15*a*) of the second section (15);

a bottom of the housing (50) is provided with a main buckle portion (55) and a secondary buckle portion (56) for fixing the first area (11) and the second area (12) as well as the distal end (14*a*) of the first section (14) and the distal end (15*a*) of the second section (15) respectively;

the housing (50) is provided with a rib-shaped restriction portion (57) and a block-shaped secondary restriction portion (58) located above the restriction portion (57) for fixing the base portion (10*a*) of the conductor assembly (10).

4. The conductor assembly structure as claimed in claim 2, wherein the conductor assembly (10) is installed in a housing (50) made of an insulating material, the housing (50) has an operation hole (52) and a wire inlet (51) for insertion of a wire;

the housing (50) being formed with a hole (53) for positioning the elastic member (20), the housing (50) being provided with a rib-shaped stop portion (54), a distal end (14*a*) of the first section (14) defines a recess (14*b*), a lip (15*b*) protrudes from a distal end (15*a*) of the second section (15);

a bottom of the housing (50) is provided with a main buckle portion (55) and a secondary buckle portion (56) for fixing the first area (11) and the second area (12) as well as the distal end (14*a*) of the first section (14) and the distal end (15*a*) of the second section (15) respectively;

the housing (50) is provided with a rib-shaped restriction portion (57) and a block-shaped secondary restriction portion (58) located above the restriction portion (57) for fixing the base portion (10*a*) of the conductor assembly (10).

5. The conductor assembly structure as claimed in claim 1, wherein at least one of the first area (11) and the second area (12) defines a space (30);

at least one of the first area (11) and the second area (12) is provided with a shoulder (17) close to the space (30) to define an opening (31) communicating with the space (30).

6. The conductor assembly structure as claimed in claim 2, wherein at least one of the first area (11) and the second area (12) defines a space (30);

at least one of the first area (11) and the second area (12) is provided with a shoulder (17) close to the space (30) to define an opening (31) communicating with the space (30).

7. The conductor assembly structure as claimed in claim 3, wherein at least one of the first area (11) and the second area (12) defines a space (30);

at least one of the first area (11) and the second area (12) is provided with a shoulder (17) close to the space (30) to define an opening (31) communicating with the space (30).

8. The conductor assembly structure as claimed in claim 4, wherein at least one of the first area (11) and the second area (12) defines a space (30);

at least one of the first area (11) and the second area (12) is provided with a shoulder (17) close to the space (30) to define an opening (31) communicating with the space (30).

9. The conductor assembly structure as claimed in claim 1, wherein the load arm (16) is in a T-shaped configuration and has a secondary arm (16*a*), the secondary arm bearing against the elastic member (20) for receiving the elastic force therefrom;

one end of the load arm (16) is connected to at least one of the first section (14) and the second section (15) and transfers the elastic force thereto.

10. The conductor assembly structure as claimed in claim 2, wherein the load arm (16) is in a T-shaped configuration and has a secondary arm (16*a*), the secondary arm bearing against the elastic member (20) for receiving the elastic force therefrom;

one end of the load arm (16) is connected to at least one of the first section (14) and the second section (15) and transfers the elastic force thereto.

11. The conductor assembly structure as claimed in claim 3, wherein the load arm (16) is in a T-shaped configuration and has a secondary arm (16*a*), the secondary arm bearing against the elastic member (20) for receiving the elastic force therefrom;

one end of the load arm (16) is connected to at least one of the first section (14) and the second section (15) and transfers the elastic force thereto.

12. The conductor assembly structure as claimed in claim 4, wherein the load arm (16) is in a T-shaped configuration and has a secondary arm (16*a*), the secondary arm bearing against the elastic member (20) for receiving the elastic force therefrom;

one end of the load arm (16) is connected to at least one of the first section (14) and the second section (15) and transfers the elastic force thereto.

13. The conductor assembly structure as claimed in claim 5, wherein the load arm (16) is in a T-shaped configuration and has a secondary arm (16*a*), the secondary arm bearing against the elastic member (20) for receiving the elastic force therefrom;

one end of the load arm (16) is connected to at least one of the first section (14) and the second section (15) and transfers the elastic force thereto, at least one portion of the load atm (16) and the secondary arm (16*a*) are located in the space (30).

14. The conductor assembly structure as claimed in claim 6, wherein the load arm (16) is in a T-shaped configuration and has a secondary arm (16*a*), the secondary arm bearing against the elastic member (20) for receiving the elastic force therefrom;

one end of the load arm (16) is connected to at least one of the first section (14) and the second section (15) and transfers the elastic force thereto, at least one portion of the load arm (16) and the secondary arm (16*a*) are located in the space (30).

15. The conductor assembly structure as claimed in claim 7, wherein the load arm (16) is in a T-shaped configuration and has a secondary arm (16*a*), the secondary arm bearing against the elastic member (20) for receiving the elastic force therefrom;

one end of the load arm (16) is connected to at least one of the first section (14) and the second section (15) and transfers the elastic force thereto, at least one portion of the load arm (16) and the secondary arm (16*a*) are located in the space (30).

16. The conductor assembly structure as claimed in claim 8, wherein the load arm (16) is in a T-shaped configuration and has a secondary arm (16*a*), the secondary arm bearing against the elastic member (20) for receiving the elastic force therefrom;

one end of the load arm (16) is connected to at least one of the first section (14) and the second section (15) and transfers the elastic force thereto, at least one portion of the load arm (16) and the secondary arm (16*a*) are located in the space (30).

17. The conductor assembly structure as claimed in claim 1, wherein the elastic member (20) is in a U-shaped configuration having a groove (21) and two closed portions (22) located at two ends of the groove (21);

the elastic member (20) is formed with at least one oblique raised portion (23) disposed adjacent the groove (21).

18. The conductor assembly structure as claimed in claim 2, wherein the elastic member (20) is in a U-shaped configuration having a groove (21) and two closed portions (22) located at two ends of the groove (21);

the elastic member (20) is formed with at least one oblique raised portion (23) disposed adjacent the groove (21).

19. The conductor assembly structure as claimed in claim 3, wherein the elastic member (20) is in a U-shaped configuration having a groove (21) and two closed portions (22) located at two ends of the groove (21);

the elastic member (20) is formed with at least one oblique raised portion (23) disposed adjacent the groove (21).

20. The conductor assembly structure as claimed in claim 1, wherein the elastic member (20) is in a U-shaped configuration having a groove (21) and two closed portions (22) located at two ends of the groove (21);

the elastic member (20) is formed with at least one oblique raised portion (23) disposed adjacent the groove (21).

21. The conductor assembly structure as claimed in claim 13, wherein the elastic member (20) is in a U-shaped configuration having a groove (21) and two closed portions (22) located at two ends of the groove (21), the elastic member (20) is formed with at least one oblique raised portion (23) disposed adjacent the groove (21);

the load arm (16) passes through the groove (21) of the elastic member (20), the closed portions (22) abut against the secondary arm (16*a*) and the shoulder (17) respectively so that the elastic member (20) is located in the space (30).

22. The conductor assembly structure as claimed in claim 14, wherein the elastic member (20) is in a U-shaped configuration having a groove (21) and two closed portions (22) located at two ends of the groove (21), the elastic member (20) is formed with at least one oblique raised portion (23) disposed adjacent the groove (21);

the load arm (16) passes through the groove (21) of the elastic member (20), the closed portions (22) abut against the secondary arm (16*a*) and the shoulder (17) respectively so that the elastic member (20) is located in the space (30).

23. The conductor assembly structure as claimed in claim 15, wherein the elastic member (20) is in a U-shaped configuration having a groove (21) and two closed portions (22) located at two ends of the groove (21), the elastic member (20) is formed with at least one oblique raised portion (23) disposed adjacent the groove (21);

the load arm (16) passes through the groove (21) of the elastic member (20), the closed portions (22) abut against the secondary arm (16*a*) and the shoulder (17) respectively so that the elastic member (20) is located in the space (30).

24. The conductor assembly structure as claimed in claim 16, wherein the elastic member (20) is in a U-shaped configuration having a groove (21) and two closed portions (22) located at two ends of the groove (21), the elastic member (20) is formed with at least one oblique raised portion (23) disposed adjacent the groove (21);

the load arm (16) passes through the groove (21) of the elastic member (20), the closed portions (22) abut against the secondary arm (16*a*) and the shoulder (17) respectively so that the elastic member (20) is located in the space (30).

25. The conductor assembly structure as claimed in claim 1, wherein at last one of the first area (11) and the second area (12) of the conductor assembly (10) is provided with a secondary shoulder (17*a*).

26. The conductor assembly structure as claimed in claim 2, wherein at last one of the first area (11) and the second area (12) of the conductor assembly (10) is provided with a secondary shoulder (17*a*).

27. The conductor assembly structure as claimed in claim 3, wherein at last one of the first area (11) and the second area (12) of the conductor assembly (10) is provided with a secondary shoulder (17*a*).

28. The conductor assembly structure as claimed in claim 4, wherein at last one of the first area (11) and the second area (12) of the conductor assembly (10) is provided with a secondary shoulder (17*a*).

29. The conductor assembly structure as claimed in claim 9, wherein at last one of the first area (11) and the second area (12) of the conductor assembly (10) is provided with a secondary shoulder (17*a*);

a distance (w) is defined between the secondary shoulder (17*a*) and the secondary arm (16*a*).

30. The conductor assembly structure as claimed in claim 10, wherein at last one of the first area (11) and the second area (12) of the conductor assembly (10) is provided with a secondary shoulder (17*a*);

a distance (w) is defined between the secondary shoulder (17*a*) and the secondary arm (16*a*).

31. The conductor assembly structure as claimed in claim 11, wherein at last one of the first area (11) and the second area (12) of the conductor assembly (10) is provided with a secondary shoulder (17*a*);

a distance (w) is defined between the secondary shoulder (17*a*) and the secondary arm (16*a*).

32. The conductor assembly structure as claimed in claim 12, wherein at last one of the first area (11) and the second area (12) of the conductor assembly (10) is provided with a secondary shoulder (17*a*);

a distance (w) is defined between the secondary shoulder (17*a*) and the secondary arm (16*a*).

33. The conductor assembly structure as claimed in claim 5, wherein the conductor assembly (10) is provided with a secondary shoulder (17*a*) in the space (30).

34. The conductor assembly structure as claimed in claim 6, wherein the conductor assembly (10) is provided with a secondary shoulder (17*a*) in the space (30).

35. The conductor assembly structure as claimed in claim 7, wherein the conductor assembly (10) is provided with a secondary shoulder (17*a*) in the space (30).

36. The conductor assembly structure as claimed in claim 8, wherein the conductor assembly (10) is provided with a secondary shoulder (17*a*) in the space (30).

* * * * *